United States Patent [19]

Martinou et al.

[11] Patent Number: 4,707,191

[45] Date of Patent: Nov. 17, 1987

[54] PICKLING PROCESS FOR HEAT-RESISTANT ALLOY ARTICLES

[75] Inventors: Robert Martinou, Bry sur Marne; Michel Ruimi, Paris, both of France

[73] Assignee: Societe Nationale d'Etude et de Construction de Moteurs d'Aviation (SNECMA), France

[21] Appl. No.: 9,096

[22] Filed: Jan. 29, 1987

Related U.S. Application Data

[63] Continuation of Ser. No. 707,965, Mar. 4, 1985, abandoned.

[30] Foreign Application Priority Data

Mar. 9, 1984 [FR] France ..... 84 04169

[51] Int. Cl.[4] ..... C23G 1/02

[52] U.S. Cl. ..... 134/3; 134/28; 134/29; 134/41

[58] Field of Search ..... 134/1, 3, 7, 28, 29, 134/41; 252/100, 101, 142

[56] References Cited

U.S. PATENT DOCUMENTS

| | | | |
|---|---|---|---|
| 1,939,241 | 12/1933 | Taylor . | |
| 2,455,411 | 12/1948 | Franchi | 134/3 |
| 2,662,814 | 12/1953 | Swihart | 134/3 X |
| 2,913,360 | 11/1959 | Zaremski et al. . | |
| 3,011,923 | 12/1961 | Coffer | 134/3 |
| 3,132,975 | 5/1964 | Freud | 134/28 X |
| 3,197,341 | 7/1965 | Wallace . | |
| 3,460,989 | 8/1969 | Rusch | 134/28 X |
| 3,489,625 | 1/1970 | Dell et al. | 134/28 X |
| 3,544,356 | 12/1970 | Vazirani | 134/28 X |
| 4,425,185 | 1/1984 | Fishter et al. | 134/3 X |

FOREIGN PATENT DOCUMENTS

| | | |
|---|---|---|
| 1292467 | 3/1962 | France . |
| 2400069 | 3/1979 | France . |

OTHER PUBLICATIONS

Chem. Ab. 88:40722k.

*Primary Examiner*—Arthur L. Corbin
*Attorney, Agent, or Firm*—Bacon and Thomas

[57] ABSTRACT

A pickling bath for iron or nickel based heat-resistance alloy article having at least 3.5% molybdenum is disclosed. The bath consists of an aqueous solution of hydrochloric acid, nitric acid, acetic acid, phosphoric acid and further contains a ferric salt. Processes for using the bath to treat said alloy articles are also disclosed.

19 Claims, No Drawings

PICKLING PROCESS FOR HEAT-RESISTANT ALLOY ARTICLES

This application is a continuation of application Ser. No. 707,965, filed Mar. 4, 1985, now abandoned.

BACKGROUND OF THE INVENTION

1. Field of the Invention

The invention relates to a surface treatment bath which applies chemical dissolution and/or deoxidation sulfurization for articles formed of a heat-resistant nickel alloy. It is particularly adapted for such alloys containing between 3.5 and 10% of molybdenum.

2. Brief Description of the Prior Art

During the fabrication of parts for turbojetengines and the like, for instance prior to welding operations, it is necessary to remove the metal oxide surface layer formed on heat-resistant alloy parts. The surface layer of such oxides is usually formed on the articles during the course of preceding thermal treatment of the articles.

It is also necessary to remove the surface layer of turbojetengine parts which have been in operation for hundreds of hours before such parts may be repaired. During their normal course of operation, the parts are exposed to corrosive, high-temperature gases which form oxysulfides containing the oxides of the metals from which the parts are made and sulfides of various origins.

The conventional procedures for eliminating such hot-formed oxides involve alkaline degreasing followed by decarbonization in an acid or alkaline medium. A subsequent oxide treatment may involve a medium of potassium permanganate plus potassium hydroxide, or may be accomplished by passing the article through a molten soda bath. The final phase of the treatment process involves removing the residual oxides and scouring by immersion in a nitrohydrofluoric acid.

However, it has been found that these baths are ineffective when parts made of NC22KDA, NC25D, or Z10CNKDW20 alloys were pickled and the nitrohydrofluoric acid bath produced undesirable intergranular corrosion. An analysis of these typical alloys indicated that they contained a somewhat high proportion of molybdenum; NC22KDA, commercially called INCO617 contains 8–10% molybdenum; NC25D, commercially known as NIMONIC86 contains 10.65% molybdenum; Z10CNKDW20, commercially known as HA556 includes 2.5–4% molybdenum; NK17CDAT, commercially known as ASTROLOY contains 4.5–5.5% molybdenum; and NC14K8 commercially known as RENE95, contains 3.5% molybdenum.

SUMMARY OF THE INVENTION

It is the object of the present invention to provide a chemical cleansing or pickling bath which chemically dissolves and/or deoxysulferizes which includes anions in proportions capable of dissolving the oxides of the alloy metal, particularly molybdenum oxides.

The invention also describes a process for using this bath to chemically cleanse parts which were oxidized during their manufacture in order to achieve a surface suitable for subsequent manufacturing processes. The bath and process according to the invention may also be utilized to chemically cleanse parts covered with oxysulfides and/or oxides during their normal operational time.

According to the invention, a bath was prepared of which the elements were selected for their action on the metals present in the alloys:

phosphate ion: chromium aluminum nickel,
acetate ion: molybdenum, aluminum,
sulfate ion: molybdenum, nickel,
chloride ion: chromium,
nitrate ion: chromium, titanium,
ferric ion: controls acid corrosion.

DETAILED DESCRIPTION OF THE PREFERRED EMBODIMENTS

A pickling bath according to the invention may have the following composition:

water: 180±50 ml/liter,
ferric sulfate: 160±46 g/liter
hydrochloric acid (d=1.18): 460±100 ml/liter,
acetic acid (d=1.05): 115±20 ml/liter,
phosphoric acid (d=1.70): 85±15ml/liter
nitric acid (d=1.14): 160±40 ml/liter.

The tolerances in the preferred embodiment noted above correspond to the acceptable deviations in the concentrations when the bath is used repeatedly and have no affect on the effectiveness of the bath. The densities (d) noted above correspond to typical values found in commercial products.

The $H+/NO_3$ ratio was chosen to decrease the materials passivity during chemical dissolution. The free acidity is somewhat high (12.25N) to activate the material surface.

The bath noted above is preferably prepared in a tank having a plastic lining by introducing the components into the tank in the order noted above. The listed amount of water is put into the tank, then the ferric sulfate is slowly added until it is completely dissolved. Next, the hydrochloric acid is slowly poured in small amounts while agitating the solution with a compressed air jet. Thereafter, the three other acids are introduced in the noted order and in the same manner. The temperature must be monitored during the preparation of the bath and care must be taken to insure that it does not exceed 45° C., especially when hydrochloric acid is introduced, in order to avoid splashes.

In an alternative embodiment, rather than using the iron in its ferric sulfate form, the bath may be formed using ferric chloride. In that case, the ferric chloride combines with sulfuric acid to assure the ion sulfate concentration. In this embodiment, the composition of the bath is as follows:

water: 180±50 ml/liter,
sulfuric acid: 80±10 ml/liter,
hydrochloric acid: 430±100 ml/liter,
ferric chloride: 170±50 g/liter,
nitric acid: 140±40 ml/liter,
acetic acid: 110±20 ml/liter,
phosphoric acid: 85±15 ml/liter.

As in the previous embodiment the sequence and the dissolution temperature must be observed. It is preferable, however, that the first bath be used, since it does not entail the handling of sulfuric acid.

The following examples show the conditions of use and the results obtained for the preferred pickling bath solution.

EXAMPLE 1

Six articles of different alloys (Z10CNKDW20, NC25D, NK17CDAT, NC14K8, NC22KDA and NK15CDAT) covered with a layer of oxide were subjected to several descaling cycles. Each of these cycles included:

descaling the oxides by immersion for one hour in an alkaline bath, commercially known as TURCO 4008-3, at a temperature of 121°±3° C.; followed by a one hour immersion in an alkaline permanganate oxide treatment bath commercially known as TURCO 4338-C, at a temperature of 88°±5° C., to make the oxides more soluble.

removal of the oxides by immersing the articles in the ferric sulfate bath according to the first embodiment of the invention for ten minutes at a temperature of 30°±4° C.

Prior to the treatment, the average oxide thickness ranged from 0.010 to 0.030mm. Following two complete cycles as described above, the oxide layer on each of the articles had been completely eliminated. There was no discernable dissolution of the alloys after the oxide removal, and micrographic examination revealed that the bath had caused no intergranular corrosion.

EXAMPLE 2

The ferric sulfate bath according to the invention was used to deoxysulfurize turbine blades made of a nickel-based alloy (NK15CADT) to remove a thick coating of oxysulfides which had built up after 12,000 hours of operation. In this example, the articles were immersed in a known molten soda bath instead of the alkaline bath in the previous example. Equivalent results were obtained in regard to the oxide conditioning stage. A slight sanding using CORINDON of 160 microns granularity at a pressure of 3 bars was applied between the conditioning and the final acid bath to increase the effectiveness of the acid bath and to reduce the number of descaling cycles. The treatment resulted in the removal of the oxysulfide coating and no deleterious effects regarding intergranular corrosion.

EXAMPLE 3

Turbojet engine parts, namely parts of the combustion chamber, turbine blades and rotor sectors, which had been in operation for several hundred hours were subjected to treatment. These parts had received no thermochemical protection at all prior to placing them in operation. The treatment included the following steps:

In a first cycle, the oxides were descaled and conditioned in an acid bath followed by an alkaline permanganate bath. Following these known conditioning steps, the parts were immersed for approximately 7 minutes in the acid bath according to the invention at a temperature of 30°±2° C. The parts were then removed and sanded with alumina having 70 microns granularity at a pressure of 4 bars for approximately 1 minute.

In the following cycles, the parts were immersed in the acid bath according to the invention (for the same time and at the same temperature) and were subsequently sanded under the same parameters. The effectiveness of the sanding in rupturing the oxide layer and facilitating the action of the acid bath made the use of an acid or alkaline bath immersion to descale the oxides superfluous. Also, the conditioning by use of the permanganate bath was also rendered superfluous.

The parts were checked between each cycle by measuring the changes in their mass and were also checked micrographically to ascertain the effect on intergranular corrosion. The parts made of NK15CADT (commercially known as IN100), NK10CAD (commercially known as 81900) and NC13A (commercially known as INCO713) had a coating thickness of oxides and oxysulfide between 0.010 and 0.040mm after the first cycle. The thickness was reduced to between 0.010 and 0.020mm after the second cycle. Deoxidation and removal of the oxysulfides were complete following the second cycle.

It appears, therefore, that the number of cycles with sanding and immersion in the acid bath of the invention will depend upon the thickness of the oxysulfide layers. By applying the bath of the invention to entirely deoxidized control articles, a dissolution rate of the nickel based alloys on the order of 0.0013 to 0.0017mm/min was found at 30° C. This rate increases substantially (0.0024–0.0035mm/min.) where the bath temperature rises to 35° C. For this reason, articles formed of nickel based alloys should be masked in those areas which require very high tolerances (such at the foot of rotor blades). It is also preferable to limit the number of immersions for thin-walled parts formed of nickel based alloys and to preferably keep the bath temperature at 30° C. or less.

EXAMPLE 4

Descaling and deoxysulfurization tests were also carried out on cracked parts at the end of their service life, in particular rotor blades made of NW11AC (commercially known as PD21). The objective of this treatment is to prepare the parts for crack repair by diffusion welding.

The cracked parts were subjected to the following operations:

Oxide descaling in an alkaline bath at 120° for one hour followed by conditioning in an alkaline permanganate bath at 87° C. for one hour as in Example 1;

Blasting the parts with nickel-based metal grains having between 60 and 120 microns granularity at a pressure of 6 bars for one minute (the base metal of the metal grain is the same as that of the part being treated in order not to degrade the subsequent diffusion welding procedure);

Chemical deoxidation by immersion of the parts in the acid bath according to the invention at 23° C. for approximately 3 minutes, the temperature and duration being selected as a function of the wall thickness of the parts (in this example the temperature and time are somewhat restricted due to the thin wall nature of the parts), however, preferably the temperature of the acid bath will not drop below the ambient temperature (i.e. 20° C.);

Immersing the parts in a water rinsing bath with ultrasonic agitation for approximately 3 minutes;

Scouring the parts in a phosphoric acid bath containing inhibitors at 40° C. for approximately 20 minutes to eliminate residual oxides; and, Rinsing the parts in water with ultrasonic agitation for approximately 3 minutes.

All of the steps, with the exception of the initial step, are repeated twice prior to drying the parts. After subjecting the parts to this treatment, it was observed that the dissolved thicknesses were on the order of 0.030 mm and that the surface quality outside the cracks was very good. The rapid pollution of the rinsing baths by the oxide products proves the efficacy of using ultrasonic agitation to eliminate the acid bath products from the cracks. Micrographic examination indicated that no intergranular corrosion was caused by this treatment.

EXAMPLE 5

The acid bath according to the invention can also be used in preparing the surface before welding nickel based parts. Presently, before parts, such as casings, are mounted in the turboengine, the surface is prepared for welding operations by superficially removing material by mechanical means. The use of the acid bath according to the invention eliminates the perturbed coat in one chemical operation thereby reducing the time and costs for preparing such articles.

The steps include alkaline degreasing (or equivalent) the surface of the article, followed by depassivation in an HCl medium prior to immersing the parts in the acid bath of the invention for approximately 7 minutes at 30° C. The parts are removed and subsequently rinsed in water and then scoured in a nitrohydrofluoric bath for approximately 3 minutes at room temperature.

The dissolved thickness was observed to be approximately 0.010 mm under those operational parameters. It was further noted that after inadvertently immersing a part in the acid bath for a period of approximately 25 minutes the dissolved thickness was 0.048 mm and the substrate was free of any intergranular corrosion.

The foregoing is provided for illustrative purposes only and should not be construed as in any way limiting this invention, the scope of which is defined solely by the appended claims.

What is claimed is:

1. A pickling process for heat resistant articles formed from a nickel alloy having a molybdenum content of at least 3.5% comprising the steps of:

(a) descaling surface layer oxides from the article by:
  (i) immersing the articles in an acid or alkaline bath; and,
  (ii) subsequently immersing the articles in an alkaline permanganate bath;
(b) immersing the articles in a bath of a mixture of 15–55% hydrochloric acid; nitric acid; 6–15% acetic acid; 7–15% phosphoric acid; 8–20% water; and a ferric salt for a period of between 3 and 10 minutes to clean oxysulfides from the articles;
(c) maintaining the temperature of the bath between 20° and 35° C.;
(d) removing the articles from the acid mixture bath and immersing them in a plurality of water rinse baths; and then
(e) ultrasonically agitating at least one of the water rinse baths.

2. The pickling process according to claim 1 wherein the initial step comprises immersing the articles in a molten soda bath.

3. The pickling process according to claim 1 wherein the descaling comprises the additional step of blasting the articles with a powder having a granularity of between 60 and 120 microns.

4. The pickling process according to claim 3 wherein the powder is formed of the metal of the base constituent of the alloy of the article to be treated.

5. The pickling process according to claim 4 comprising the additional step of mixing the acid bath so as to have the following composition:

water: 180±50 ml/liter,
ferric sulfate: 160±45 g/liter,
hydrochloric acid: 460±100 ml/liter,
nitric acid: 160±40 ml/liter,
acetic acid: 115±20 ml/liter,
phosphoric acid: 85±15 ml/liter.

6. The pickling process according to claim 4 comprising the additional step of mixing the acid bath so as to have the following composition:

water: 180±50 ml/liter,
sulfuric acid: 80±10 ml/liter,
hydrochloric acid: 430±100 ml/liter,
ferric chloride: 170±50 g/liter,
nitric acid: 140±40 ml/liter,
acetic acid: 110±20 ml/liter,
phosphoric acid: 85±15 ml/liter.

7. The pickling process according to claim 3 comprising the additional step of mixing the acid bath so as to have the following composition:

water: 180±50 ml/liter,
ferric sulfate: 160±45 g/liter,
hydrochloric acid: 460±100 ml/liter,
nitric acid: 160±40 ml/liter,
acetic acid: 115±20 ml/liter,
phosphoric acid: 85±15 ml/liter.

8. The pickling process according to claim 3 comprising the additional step of mixing the acid bath so as to have the following composition:

water: 180±50 ml/liter,
sulfuric acid: 80±10 ml/liter,
hydrochloric acid: 430±100 ml/liter,
ferric chloride: 170±50 g/liter,
nitric acid: 140±40 ml/liter,
acetic acid: 110±20 ml/liter,
phosphoric acid: 85±15 ml/liter.

9. The pickling process according to claim 1, comprising the additional step of degreasing the surfaces of the articles prior to immersing in the acid bath.

10. The pickling process according to claim 9 wherein the degreasing step is followed by acid depassivation.

11. The pickling process according to claim 10 comprising the additional step of mixing the acid bath so as to have the following composition:

water: 180±50 ml/liter,
ferric sulfate: 160±45 g/liter,
hydrochloric acid: 460±100 ml/liter,
nitric acid: 160±40 ml/liter,
acetic acid: 115±20 ml/liter,
phosphoric acid: 85±15 ml/liter.

12. The pickling process according to claim 10 comprising the additional step of mixing the acid bath so as to have the following composition:

water: 180±50 ml/liter,
sulfuric acid: 80±10 ml/liter,
hydrochloric acid: 430±100 ml/liter,
ferric chloride: 170±50 g/liter,
nitric acid: 140±40 ml/liter,
acetic acid: 110±20 ml/liter,
phosphoric acid: 85±15 ml/liter.

13. The pickling process according to claim 9 comprising the additional step of mixing the acid bath so as to have the following composition:

water: 180±50 ml/liter,
ferric sulfate: 160±45 g/liter,
hydrochloric acid: 460±100 ml/liter,
nitric acid: 160±40 ml/liter,
acetic acid: 115±20 ml/liter,
phosphoric acid: 85±15 ml/liter.

14. The pickling process according to claim 9 comprising the additional step of mixing the acid bath so as to have the following composition:

water: 180±50 ml/liter,
sulfuric acid: 80±10 ml/liter,
hydrochloric acid: 430±100 ml/liter,
ferric chloride: 170±50 g/liter,
nitric acid: 140±40 ml/liter,
acetic acid: 110±20 ml/liter,
phosphoric acid: 85±15 ml/liter.

15. The pickling process according to claim claim 1 comprising the additional step of scouring the articles following their removal from the acid mixture bath by immersion in an inhibited phosphoric or nitrohydrofluoric acid bath.

16. The pickling process according to claim 15 comprising the additional step of mixing the acid mixture bath so as to have the following composition:
water: 180±50 ml/liter 15.5%,
ferric sulfate: 160±45 g/liter,
hydrochloric acid: 460±100 ml/liter,
nitric acid: 160±40 ml/liter,
acetic acid: 115±20 ml/liter,
phosphoric acid: 85±15 ml/liter.

17. The pickling process according to claim 15 comprising the additional step of mixing the acid mixture bath so as to have the following composition:
water: 180±50 ml/liter,
sulfuric acid: 80±10 ml/liter,
hydrochloric acid: 430±100 ml/liter,
ferric chloride: 170±50 g/liter,
nitric acid: 140±40 ml/liter,
acetic acid: 110±20 ml/liter,
phosphoric acid: 85±15 ml/liter,

18. The pickling process according to claim 1 comprising the additional step of mixing the acid bath so as to have the following composition:
water: 180±50 ml/liter,
ferric sulfate: 160±45 g/liter,
hydrochloric acid: 460±100 ml/liter,
nitric acid: 160±40 ml/liter,
acetic acid: 115±20 ml/liter,
phosphoric acid: 85±15 ml/liter.

19. The pickling process according to claim claim 1, comprising the additional step of mixing the acid bath so as to have the following composition:
water: 180±50 ml/liter,
sulfuric acid: 80±10 ml/liter,
hydrochloric acid: 430±100 ml/liter,
ferric chloride: 170±50 g/liter,
nitric acid: 140±40 ml/liter,
acetic acid: 110±20 ml/liter,
phosphoric acid: 85±15 ml/liter.

* * * * *

UNITED STATES PATENT AND TRADEMARK OFFICE

CERTIFICATE OF CORRECTION

PATENT NO. : 4,707,191

DATED : Nov. 17, 1987

INVENTOR(S) : MARTINOU ET AL

It is certified that error appears in the above—identified patent and that said Letters Patent is hereby corrected as shown below:

Column 3, line 9, should have a ";" after "soluble".

Column 4, line 5, oxysulfide should be "oxysulfides".

Column 4, line 17, where should be "when".

Column 4, line 20, "such at the foot..." should be --such as at the foot...--.

Column 4, line 35, "120°" should be --120° C.

Column 5, line 8, "turboengine" should be --turbojet engine--.

Column 8, claim 19, the second "claim" should be deleted.

Signed and Sealed this

Twenty-seventh Day of September, 1988

*Attest:*

DONALD J. QUIGG

*Attesting Officer*

*Commissioner of Patents and Trademarks*